US007301422B2

(12) United States Patent
Zimmerman et al.

(10) Patent No.: US 7,301,422 B2
(45) Date of Patent: Nov. 27, 2007

(54) VARIABLE DIFFERENTIAL PHASE SHIFTER HAVING A DIVIDER WIPER ARM

(75) Inventors: Martin L. Zimmerman, Chicago, IL (US); Jonathon C. Veihl, New Lenox, IL (US)

(73) Assignee: Andrew Corporation, Westchester, IL (US)

( * ) Notice: Subject to any disclaimer, the term of this patent is extended or adjusted under 35 U.S.C. 154(b) by 18 days.

(21) Appl. No.: 11/143,377

(22) Filed: Jun. 2, 2005

(65) Prior Publication Data

US 2006/0273864 A1 Dec. 7, 2006

(51) Int. Cl.
*H01P 1/18* (2006.01)
*H01P 5/12* (2006.01)

(52) U.S. Cl. ..... 333/161; 333/156; 333/128; 333/117

(58) Field of Classification Search ..... 333/156, 333/161, 125, 127, 128, 136
See application file for complete search history.

(56) References Cited

U.S. PATENT DOCUMENTS 2,831,169 A * 4/1958 Casal ..... 333/160
2,951,996 A * 9/1960 Pan ..... 333/128
4,636,755 A * 1/1987 Gibbs ..... 333/116
4,737,747 A * 4/1988 Henderson et al. ..... 333/246
5,705,962 A * 1/1998 Fleeger et al. ..... 333/136
6,831,602 B2 * 12/2004 McKinzie et al. ..... 342/375
6,850,130 B1 2/2005 Gottl et al.
6,922,169 B2 7/2005 Moh'd Izzat et al.

FOREIGN PATENT DOCUMENTS

WO WO 02/05383 1/2002

* cited by examiner

*Primary Examiner*—Benny Lee
(74) *Attorney, Agent, or Firm*—Welsh & Katz, Ltd.

(57) ABSTRACT

A variable differential phase shifter including an isolation element providing good isolation between output ports, good return loss and reduced reflections. In one embodiment a Wilkinson divider is incorporated in the wiper arm of a wiper type variable differential phase shifter. In another embodiment a linear phase shifter incorporates a Wilkinson divider. Multistage embodiments are also disclosed. The variable differential phase shifter may be used in combination with a hybrid coupler to provide an isolated variable power divider. The variable differential phase shifter may be utilized in a variety of feed networks and antenna arrays to vary beam tilt, beam azimuth and beam width. Antennas incorporating the phase shifter exhibit low variation of half power beam width with frequency and reduced side lobes.

28 Claims, 7 Drawing Sheets

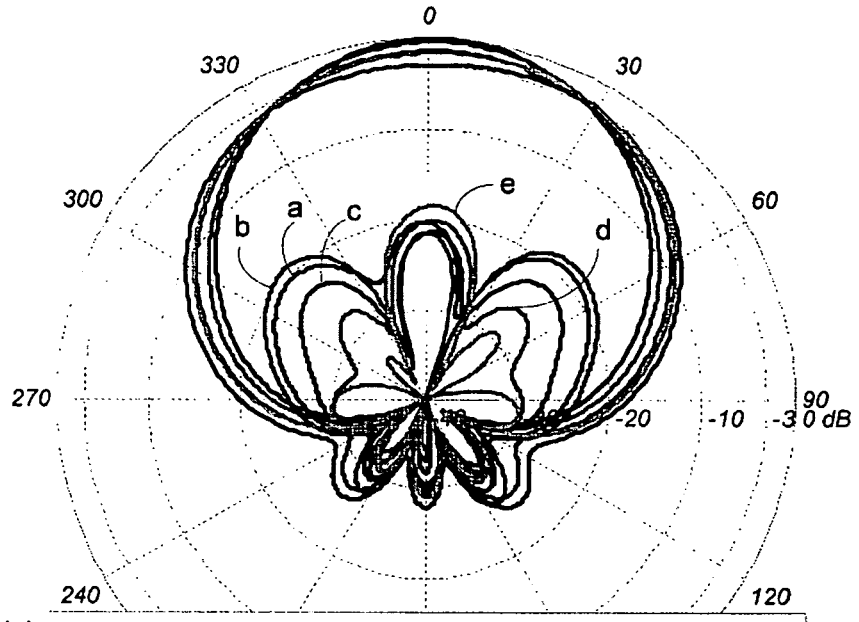
(a) ——— 824.0 MHz: 90.8° HPBW, 5.89 dBi, (4.1° Center)
(b) ——— 841.5 MHz: 69.6° HPBW, 6.87 dBi, (3.5° Center)
(c) ——— 859.0 MHz: 52.8° HPBW, 7.91 dBi, (2.3° Center)
(d) ——— 876.5 MHz: 57.2° HPBW, 7.58 dBi, (2.9° Center)
(e) ——— 894.0 MHz: 75.8° HPBW, 6.56 dBi, (4.4° Center)
Fig. 11 - Prior Art
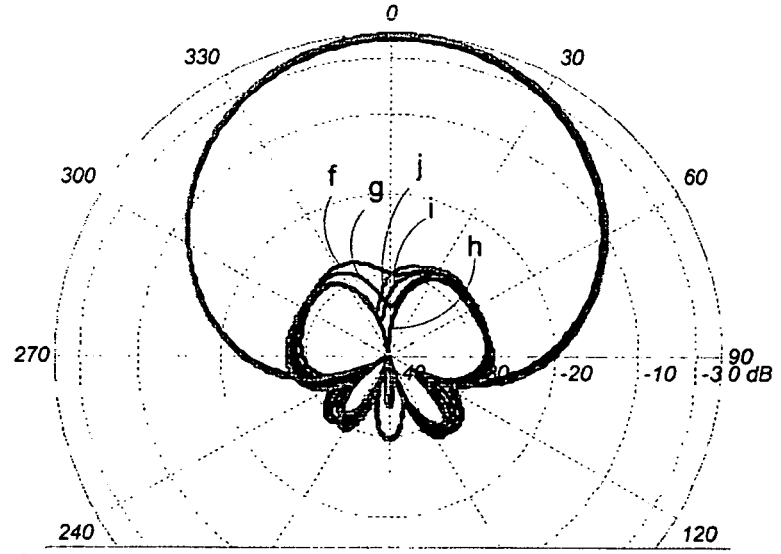
(f) ——— 824.0 MHz: 61.3° HPBW, 7.33 dBi, (2.9° Center)
(g) ——— 841.5 MHz: 60.6° HPBW, 7.38 dBi, (2.9° Center)
(h) ——— 859.0 MHz: 58.9° HPBW, 7.49 dBi, (2.8° Center)
(i) ——— 876.5 MHz: 59.5° HPBW, 7.45 dBi, (3.0° Center)
(j) ——— 894.0 MHz: 61.6° HPBW, 7.32 dBi, (3.3° Center)
Fig. 12

VARIABLE DIFFERENTIAL PHASE SHIFTER HAVING A DIVIDER WIPER ARM

FIELD OF THE INVENTION

This invention relates to a variable phase shifter suitable for radio frequency applications, in particular, cellular telecommunication systems. The invention also relates to phase shifter assemblies, feed networks and antennas incorporating such a phase shifter.

BACKGROUND OF THE INVENTION

Radio frequency phase shifters are generally of one of two types. The first type uses relative movement between conductive strips to adjust the path length between ports. The second type alters the dielectric properties between first and second conductive elements. By their nature dielectric phase shifters must be much larger than phase shifters of the first type to provide an equivalent phase shift. This results in increased size and cost.

A common type of variable differential phase shifter of the first type is the wiper-type variable differential phase shifter as shown in FIG. 1. The phase shifter consists of a wiper arm 4 that is rotatable about a pivot coupler 5 so that the distal end of the wiper arm scans an arc shaped conductive strip 6. The coupling between the distal end of the wiper arm and the conductive strip is capacitive. The wiper arm is in the form of an impedance transformer to match the input and output impedances of the ports. It will be appreciated that if the wiper arm is rotated about the pivot coupler the path length between port 1 and ports 2 and 3 changes so as to vary the phase of signals output at ports 2 and 3. However, the output ports are directly connected and so there is poor isolation between output ports. In particular, if a signal is injected at one of ports 2 or 3 only half will go to port 1, with the rest either being reflected or transmitted to the other port.

U.S. Pat. No. 6,850,130 discloses phase shifter assemblies enabling simultaneous adjustment for four or more output ports. However, these phase shifters are based upon the standard variable differential phase shifter and provide poor isolation between output ports.

Wilkinson dividers are well-known and are commonly used to provide an isolated power divider using physically fixed components. However, none of the prior art phase shifters incorporate an isolation element.

Variable differential phase shifters are useful in adjusting down tilt, azimuth and beam width of antenna arrays. This is particularly useful to adjust beam tilt, beam width and azimuth for cellular communications antennas. Examples of feed networks and antennas utilizing variable differential phase shifters are shown in WO 02/05383, filed Jul. 10, 2001, entitled Cellular Antenna, and U.S. Ser. No. 10/367,055, now U.S. Pat. No. 6,922,169, issued Jul. 26, 2005, the disclosure of which is hereby incorporated by way of reference.

It would be desirable to provide a variable differential phase shifter having improved isolation between output ports as well as good return loss and antennas utilizing such phase shifters having improved radiation patterns.

SUMMARY OF THE INVENTION

According to one exemplary embodiment there is provided a variable differential phase shifter comprising: a Wilkinson divider having first and second conductive strips extending from the outputs of the divider; and third and fourth conductive strips maintained in an electrically coupled overlapping relationship with respective first and second conductive strips, wherein the power divider and the first and second conductive strips are relatively movable with respect to the third and fourth conductive strips so as to vary the effective path length from the power divider to output ports of the third and fourth conductive strips.

The phase shifter may be a wiper-type variable differential phase shifter wherein the wiper arm includes a Wilkinson divider or a linear phase shifter. Assemblies of phase shifters may be provided consisting of two or more such phase shifters. For a wiper type phase shifter assembly the third and fourth conductive strips may be in the form of concentric arcs. For a linear phase shifter assembly the third and fourth conductive strips may be opposing linear segments.

According to another exemplary embodiment there is provided an isolated variable power divider comprising a power divider for dividing power between two or more output ports and an isolated variable differential phase shifter fed by one of the output ports for providing two or more outputs having adjustable relative phase. The isolated variable differential phase shifter is of the type described above. The power divider preferably includes a pair of hybrid couplers.

According to a further exemplary embodiment there is provided a feed network for an antenna array including a variable differential phase shifter as described above.

According to another exemplary embodiment there is provided an adjustable beam antenna having a plurality of radiating elements fed by a feed network wherein the feed network includes one or more variable differential phase shifter as described above.

According to a still further exemplary embodiment there is provided a wiper-type variable differential phase shifter having a wiper arm including an isolation element which isolates the outputs of the phase shifter from each other.

According to a yet further exemplary embodiment there is provided a variable differential phase shifter comprising: a power divider having first and second conductive strips extending from the outputs of the divider; and third and fourth conductive strips maintained in an electrically coupled overlapping relationship with respective first and second conductive strips, wherein the power divider and the first and second conductive strips are relatively movable with respect to the third and fourth conductive strips so as to vary the effective path length from the power divider to output ports of the third and fourth conductive strips, and wherein the power divider includes an isolation element to provide isolation between the output ports. The isolation element may be a lossy power divider such as a Wilkinson power divider, hybrid coupler, a rat-race coupler, an edge coupler, a strip coupler, a Lange coupler etc.

BRIEF DESCRIPTION OF THE DRAWINGS

The accompanying drawings which are incorporated in and constitute part of the specification, illustrate embodiments of the invention and, together with the general description of the invention given above, and the detailed description of embodiments given below, serve to explain the principles of the invention.

FIG. 11 shows a radiation pattern of an antenna incorporating prior art wiper type phase shifters; and FIG. 12 shows a radiation pattern of an antenna incorporating phase shifters of the type shown in FIG. 5.

DETAILED DESCRIPTION OF THE INVENTION

Figure 2:
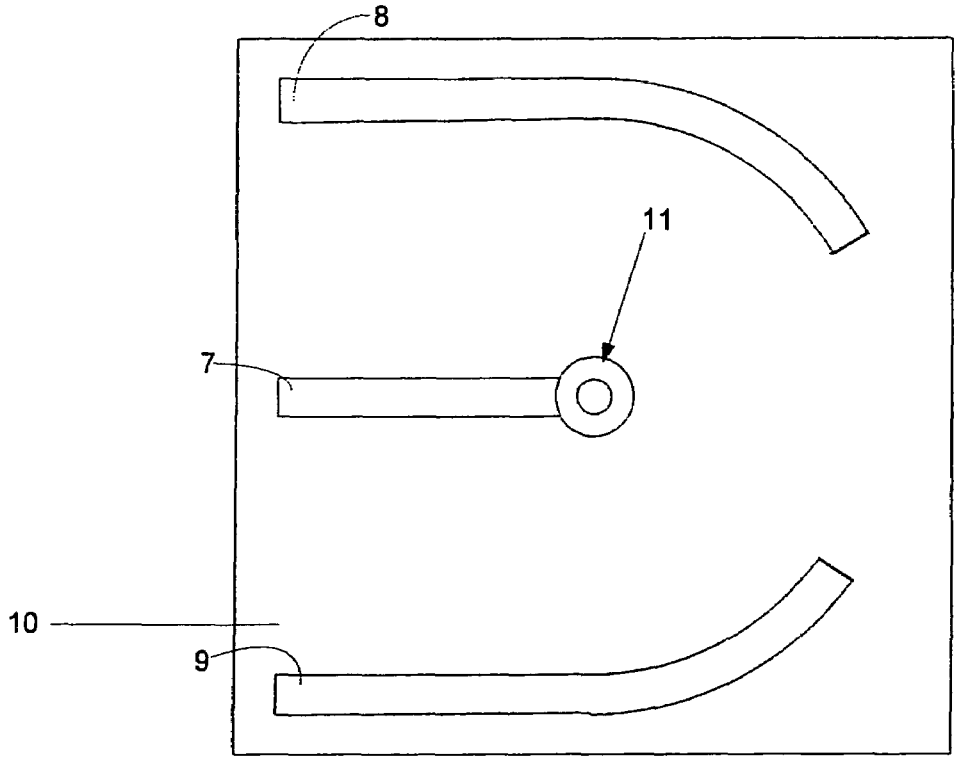
FIG. 2 shows the base portion of a phase shifter according to first embodiment.
Figure 3:
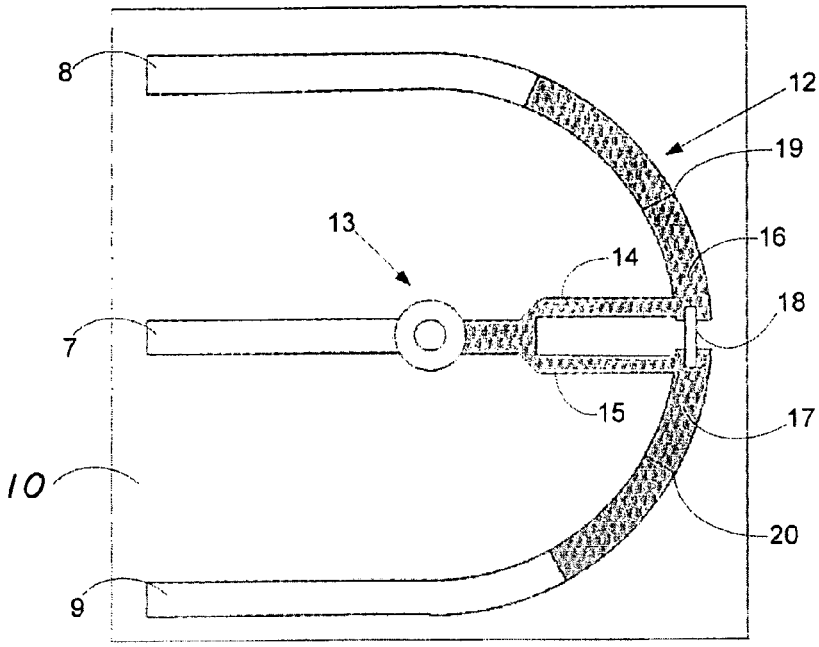
FIG. 3 shows a complete variable differential phase shifter according to a first embodiment.
Figure 4:
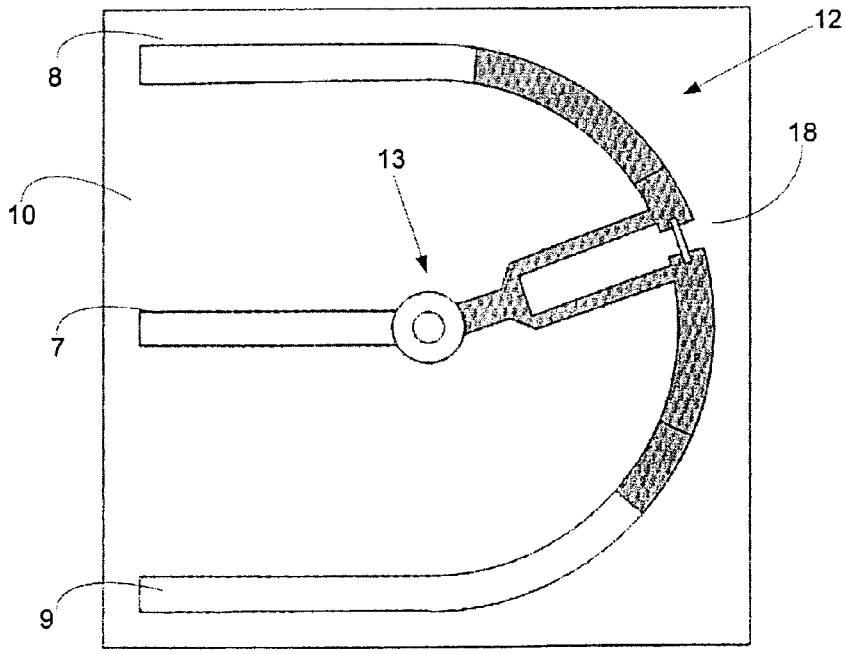
FIG. 4 shows the variable differential phase shifter of the first embodiment after a phase adjustment.

A phase shifter according to a first embodiment is shown FIGS. 2 to 4. Conductive strips 7, 8 and 9 are provided on PCB board 10. The PCB board 10 may have a ground plane in the form of a conductive metal sheet formed on the underside of the PCB board. An input signal is supplied to conductive strip 7 and fed to a coupling point 11 (FIG. 2). As seen in the complete phase shifter shown in FIG. 3 wiper arm 12 (the shaded portion) is pivotally connected to conductive coupling point 11 (FIG. 2) by a pivot coupler 13.

Wiper arm 12 (FIGS. 3-4) includes a Wilkinson divider having quarter wavelength arms 14 and 15 (FIG. 3) with conductive strips 16 and 17 (FIG. 3) extending laterally from the arms 14 and 15 (FIG. 3). The Wilkinson divider also includes a resistor 18 (FIGS. 3-4) provided across the ends of the arms 14 and 15 (FIG. 3). Wiper arm 12 (FIGS. 3-4) is rotatable about pivot coupler 13 (FIGS. 3-4), as shown in the adjusted position in FIG. 4.

The positions of the ends 19 and 20 (FIG. 3) of conductive strips 8 and 9 are indicated so that the overlap between the conductive strips 16 and 17 and conductive strips 8 and 9 can be seen. It will be seen that over the entire range of possible movement substantial overlap between the conductive strips may be provided so as to ensure a highly capacitive coupling between the conductive strips.

A gap is provided between conductive strips 8 and 9 so that the resistor 18 (FIGS. 3-4) is not shorted by conductive strips 8 and 9. As shown in FIG. 4 this means that the area of overlap of the conductive strips will vary on each side of the wiper as it has moved. This means that the capacitance on each side will change and therefore so will the reactance. For desired operation the impedance should be relatively constant over the range of wiper motion. The reactive part of the impedance is inversely proportional to capacitance. Accordingly, as long as the capacitance is always very large, the reactance due to capacitance will be very small relative to the real part of the impedance and the impedance of the junction will be fairly constant. In order to ensure a high capacitance between the conductive strips metallization is applied to the surfaces of conductive strips 16 and 17 facing conductive strips 8 and 9. Further, a thin insulating layer may be provided on at least one or both of the facing sides of conductive strips 8 and 9 or 16 and 17 so that the gap between the conductive strips is kept small. The thin insulating layer is preferably a conformal coating such as solder mask.

In use, a Wilkinson divider ensures even power division of an input signal provided to conductive strip 7 between conductive strips 16 and 17 while providing isolation between the output ports. For example, a signal supplied from conductive strip 9 to the Wilkinson divider is conducted along quarter wavelength arm 15. Part of the signal passes to conductive strip 7 and part flows to the end of quarter wavelength arm 14. Thus, the signals across resistor 18 (FIGS. 3-4) are 180° out of phase and the energy is dissipated by resistor 18. This provides good isolation between the output ports.

Figure 5:
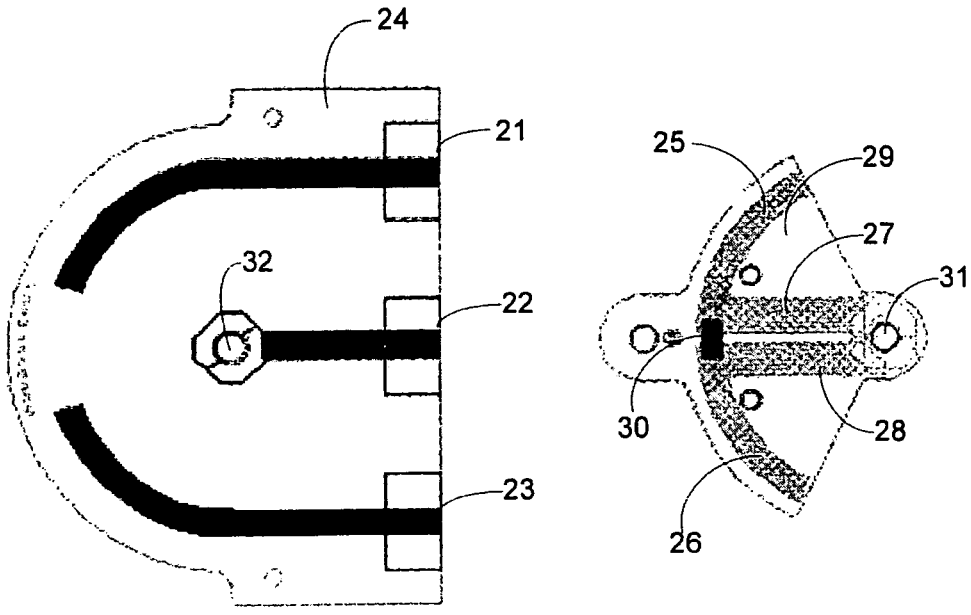
FIG. 5 shows a practical realization of the phase shifter of the first embodiment.
Figure 5A:
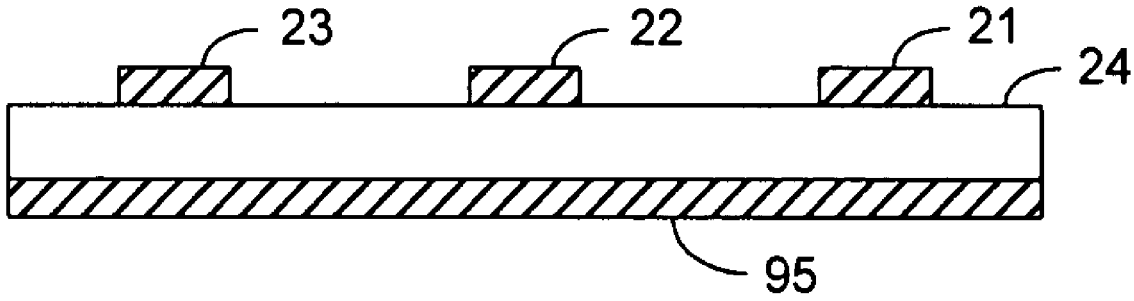
FIG. 5*a* shows a cross section of a phase shifter of the first embodiment.

Referring to FIG. 5*a*, the phase shifter may be constructed using PCB (printed circuit board) microstrip techniques, where the phase shifter is located above one ground plane 95, or stripline techniques, where the phase shifter is sandwiched between two ground planes. Using stripline techniques, the conductive strips and wiper arm may need to be cast components. It will be understood that the term "conductive strip" used in this specification includes any conductive element fulfilling its required function irrespective of its dimensions.

Referring to FIGS. 5 and 5*a*, a practical implementation of the phase shifter of the first embodiment is shown. Conductive strips 21, 22 and 23 are provided on PCB 24. As shown in FIG. 5, the conductive strips 25 and 26 and quarter wavelength arms 27 and 28 are provided on PCB 29 (these are shown shaded as they are provided on the underside of PCB 29). Resistor 30 is provided on the top face of PCB 29. This allows the conductive strips to be maintained in close proximity without the resistor in between.

The phase shifter is assembled by aligning apertures 31 and 32 and securing them via a pivot coupling. PCB 29 is then rotatable about apertures 32 to allow phase adjustment of the outputs from strip conductors 21 and 23. It will be appreciated that relative movement between PCB 24 and PCB 29 is all that is required so that PCB 24 could be moved while PCB 29 is held stationery.

FIGS. 11 and 12 show the relative performance of an antenna incorporating a prior art wiper type phase shifter and a phase shifter of the type shown in FIG. 5, respectively. FIG. 11 shows that an antenna utilizing a reactive prior art wiper type phase shifter demonstrates considerable variation in half power beam width (HPBW) with varying frequency. As shown in FIG. 11, reference letters a, b, c, d and e refer to five different frequency graphs. FIG. 12 shows the radiation pattern of an antenna incorporating a phase shifter of the type shown in FIG. 5. As shown in FIG. 12, reference letters f, g, h, i and j refer to five different frequency graphs. It will be seen that the half power beam width is very stable with respect to changes in operating frequency and the side lobes are substantially suppressed with respect to those shown in FIG. 10.

Further, a phase shifter of the type shown in FIG. 5 exhibits improved isolation and return loss compared to a conventional reactive (non-isolated) phase shifter as shown in tables 1 and 2 below.

TABLE 1

| conventional reactive (non-isolated) phase shifter | | | |
|---|---|---|---|
| Frequency | 1.71 GHz | 1.85 GHz | 1.94 GHz |
| Isolation | −15.1 dB | −17.1 dB | −18.4 dB |
| Return loss | −21.6 dB | −21.2 dB | −20.8 dB |

TABLE 2

| phase shifter of the type shown in FIG. 5 | | | |
|---|---|---|---|
| Frequency | 1.71 GHz | 1.85 GHz | 1.94 GHz |
| Isolation | −6.2 dB | −6.8 dB | −7 dB |
| Return loss | −6.7 dB | −6.2 dB | −6.1 dB |

Figure 1:
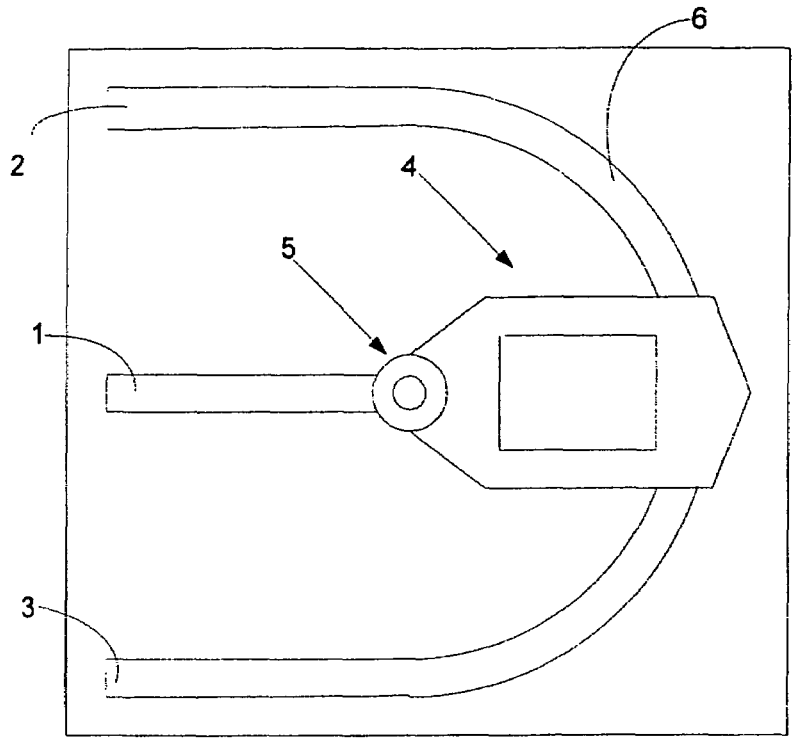
Fig. 1 Prior Art
FIG. 1 shows a prior art variable differential phase shifter.
Figure 6:
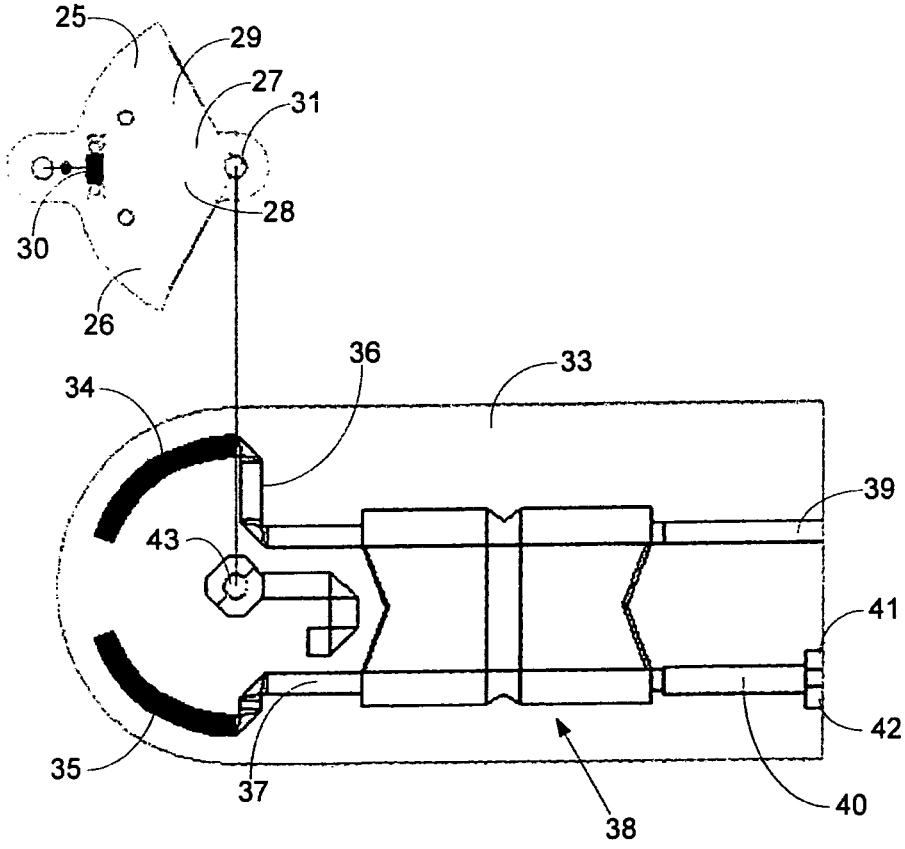
FIG. 6 shows an isolated variable power divider.

FIG. 6 shows an isolated variable power divider comprising a variable differential phase shifter of the type shown in FIG. 5 and a hybrid coupler. As the wiper arm is of the same construction as the wiper arm shown in FIG. 5, like numbering has been used. Conductive strips 34 and 35 are provided on PCB 33 and are connected to respective inputs of hybrid coupler 38 via conductive strips 36 and 37. As with the phase shifter of FIG. 5, PCB 29 is overlaid so that conductive strips 25, 26, 34 and 35 are facing each other with a pivot coupler pivotally connecting PCBs 29 and 33 about apertures 31 and 43. One output of hybrid coupler 38 is supplied to output strip 39 and the other output is supplied to power divider 40 having outputs 41 and 42. The voltage at strip 39 is controlled relative to the voltage at outputs 40 by adjusting the phase of the phase shifter. Conductive strip 36 may be made a different length than the conductive strip 37 in order to adjust the range of voltage ratios seen at 39 versus 40 so that the desired range is covered by finite amount of phase shift. In use the strip 39 may feed the central column of an antenna array whilst outputs 41 and 42 may feed the outer columns of an antenna array (see for example FIG. 1 of U.S. Pat. No. 6,922,169). This arrangement allows adjustment of azimuth beam width. It will be appreciated that in other applications power divider 40 may be omitted to provide a two output device.

Figure 7:
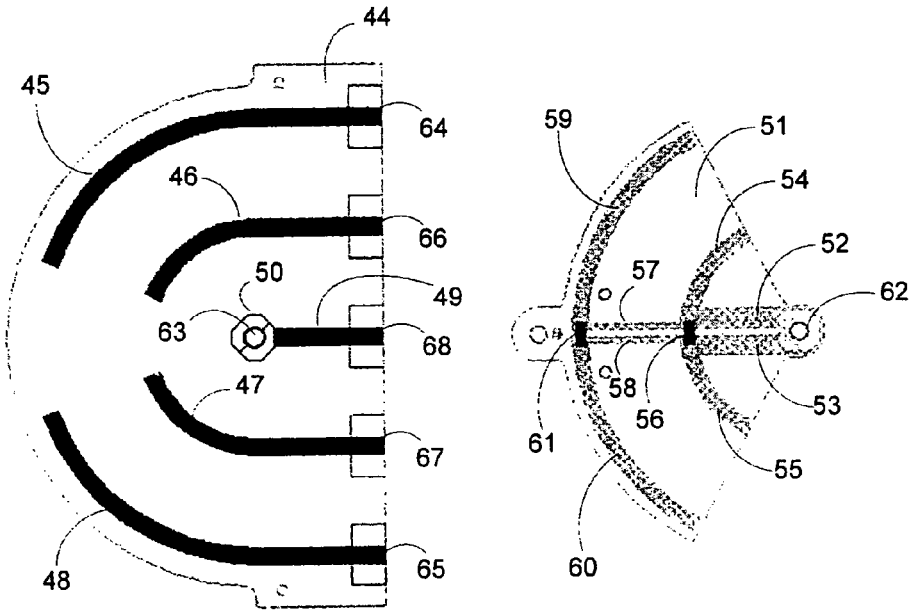
FIG. 7 shows a multistage phase shifter.

FIG. 7 shows a multistage phase shifter incorporating Wilkinson power dividers. PCB 44 includes two pairs of conductive strips 45, 48 and 46, 47 (again shaded portions are provided on the underside). Conductive strip 49 provides a feed line to coupling region 50. PCB 51 includes a first pair of quarter wavelength arms 52 and 53 feeding conductive strips 54 and 55. The resistor 56 is provided across the ends of arms 52 and 53 to form a first Wilkinson divider. A second pair of quarter wavelength arms 57 and 58 extend from the ends of arms 52 and 53 and have conductive strips 59 and 60 extending therefrom. Resistor 61 is provided across the ends of arms 57 and 58 to form a second Wilkinson divider. When PCB 51 is secured to PCB 44 via a pivot coupler through apertures 62 and 63 a variable differential phase shifter is provided in which relative rotation of PCBs 44 and 51 results in twice the phase shift at outputs 64 and 65 compared to that at outputs 66 and 67. This enables a single phase shifter to produce four outputs of different phase shift (or five if input 68 is used to feed a radiating element).

Figure 8:
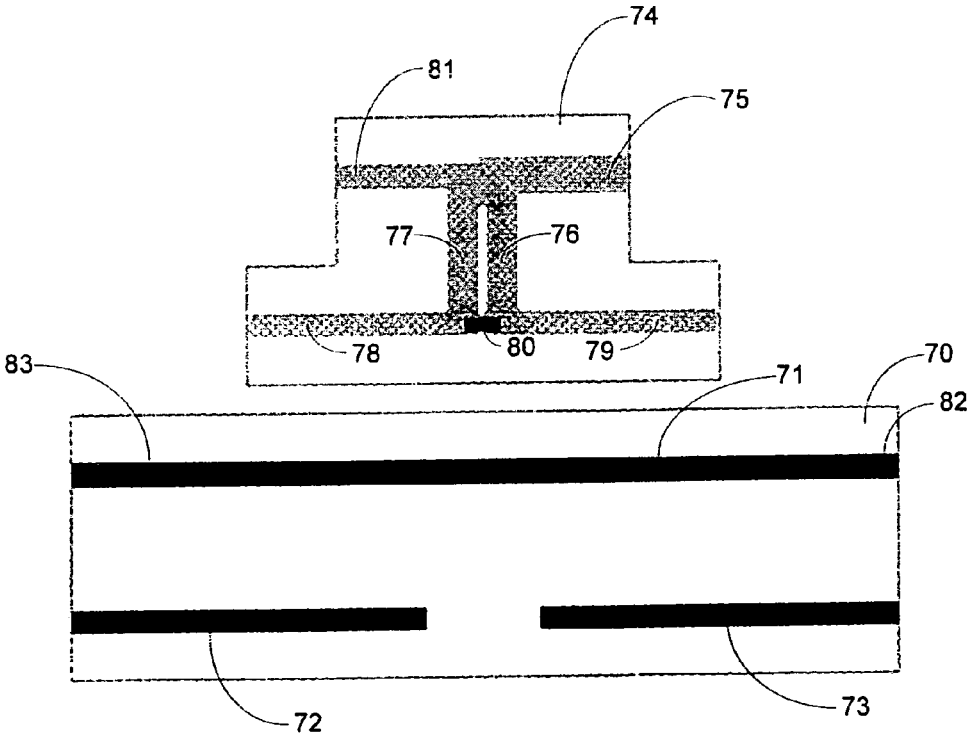
FIG. 8 shows a linear phase shifter.

FIG. 8 shows a linear phase shifter embodiment. PCB 70 includes a first conductive strip 71 and second and third conductive strips 72 and 73. PCB 74 includes a first conductive strip 75 feeding a pair of quarter wavelength arms 76 and 77. Conductive strips 78 and 79 extend from respect of arms and resistor 80 completes the Wilkinson divider. Conductive strip 81 is of reduced width for matching purposes when a signal is supplied at end 82 and an output is taken at end 83. When PCB 74 is placed on top of PCB 70 conductive strips 71 and 75, 72 and 78 and 73 and 79 face each other in an overlapping relationship to provide high capacitive coupling. By sliding the PCB 34 to the left or right with respect to PCB 70, the phase shift of signals at conductive strips 72 and 73 is varied. The Wilkinson divider insures good isolation between outputs.

Although a single Wilkinson divider is shown it will be appreciated that a number of such linear phase shifters may be provided in series or parallel configurations. A linear arrangement may be particularly suitable for feed networks having many outputs.

Figure 9:
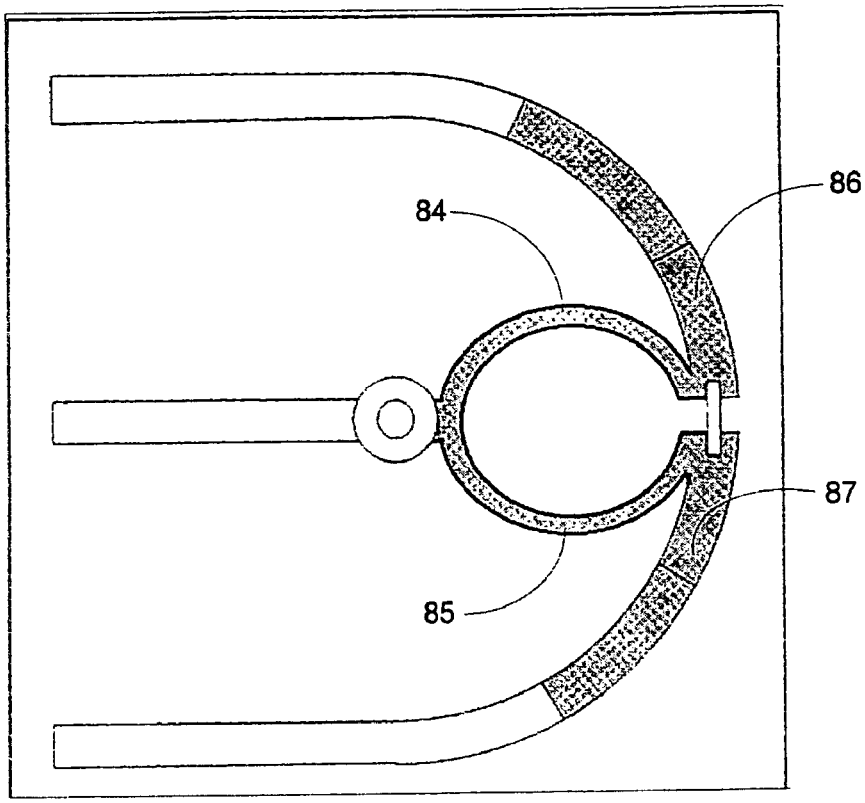
FIG. 9 shows a phase shifter incorporating curvilinear arms in the Wilkinson divider.

FIG. 9 shows a variant of the phase shifter shown in FIGS. 2 to 4. In this case the quarter wavelength arms 84 and 85 feeding conductive strips 86 and 87 are curvilinear. This configuration allows a more compact construction where only a small phase variation is required. It will be appreciated that the arms may be of different shapes and the objective is simply to provide the desired path length within the space available.

Figure 10:
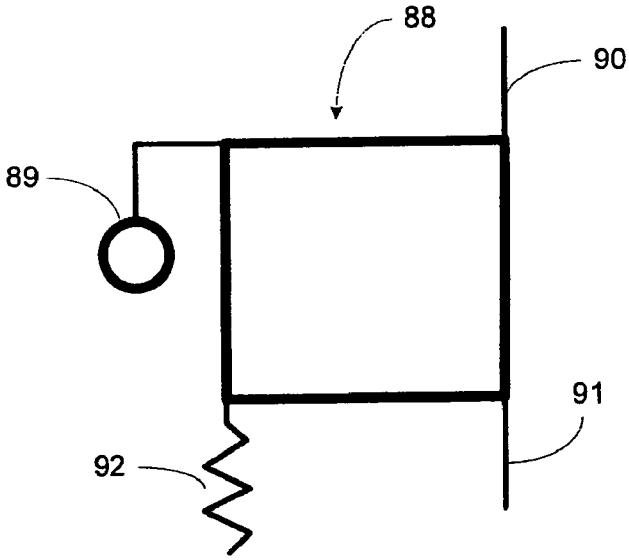
FIG. 10 shows a schematic diagram of a hybrid coupler which may be used in substitution for a Wilkinson divider.

FIG. 10 shows a schematic diagram of a hybrid coupler which may be used in substitution for the Wilkinson divider in the phase shifter of the invention. As schematically illustrated, hybrid coupler 88 has a first port connected to wiper pivot 89 and second and third ports 90 and 91 connected to wiper arms of a phase shifter. The fourth port is connected to resistor 92 having an open circuit at its other end. This arrangement allows unbalanced power division. Unbalanced power division may also be achieved using an unbalanced Wilkinson powder divider.

The phase shifters may be adjusted by suitable manual or electromechanical means, such as geared motors. In a feed network multiple phase shifters may be commonly driven in a stacked array or be differentially driven by an arrangement of gears as required.

There are thus provided phase shifters having good isolation between output ports, reduced reflections and good return loss. Antennas incorporating the phase shifters exhibit low variation of half power beam width with frequency and improved radiation patterns (particularly reduced side lobes). The phase shifter is also compact and relatively inexpensive to produce.

While the present invention has been illustrated by the description of the embodiments thereof, and while the embodiments have been described in detail, it is not the intention of the Applicant to restrict or in any way limit the scope of the appended claims to such detail. Additional advantages and modifications will readily appear to those skilled in the art. Therefore, the invention in its broader aspects is not limited to the specific details, representative apparatus and method, and illustrative examples shown and described. Accordingly, departures may be made from such details without departure from the spirit or scope of the Applicant's general inventive concept.

The invention claimed is:

1. A variable differential phase shifter comprising:

a Wilkinson divider having first and second conductive strips extending from outputs of the divider; and third and fourth conductive strips maintained in an electrically coupled overlapping relationship with respective first and second conductive strips, wherein the first and second conductive strips of the Wilkinson divider are movable with respect to the third and fourth conductive strips so as to vary an effective path length from the Wilkinson divider to output ports of the third and fourth conductive strips.

2. The phase shifter as claimed in claim 1 wherein the third and fourth conductive strips are positioned with respect to a possible range of movement of the first and second conductive strips such that the Wilkinson divider is not short circuited over the desired range of movement of the first and second conductive strips.

3. The phase shifter as claimed in claim 2 wherein the third and fourth conductive strips are spaced apart from the first and second conductive strips, respectively in height and without direct electrical interconnection therebetween.

4. The phase shifter as claimed in claim 1 wherein the Wilkinson divider includes a pair of quarter wavelength arms having a resistor between the ends of the arms pair of with the first and second conductive strips extending laterally from the ends of the arms.

5. The phase shifter as claimed in claim 4 wherein the resistor is provided on a top planar surface of the arms pair of the Wilkinson divider, said surface is opposite a planar surface facing the third and fourth conductive strips.

6. The phase shifter as claimed in claim 4 wherein metallization is applied to surfaces of the first and second conductive strips and/or surfaces of the third and fourth conductive strips.

7. The phase shifter as claimed in claim 4 wherein the first and second conductive strips and/or the third and fourth conductive strips include an insulation layer to insulate said first and second conductive strips from said third and fourth conductive strips.

8. The phase shifter as claimed in claim 4 wherein the first and second conductive strips and the third and fourth conductive strips are curvilinear, and the Wilkinson divider is part of a pivotable wiper arm.

9. The phase shifter as claimed in claim 4 wherein the pair of quarter wavelength arms of the Wilkinson divider are nonlinear in shape.

10. The phase shifter as claimed in claim 4 wherein the pair of quarter wavelength arms of the Wilkinson divider are curvilinear in shape.

11. The phase shifter as claimed in claim 1 wherein the first and second conductive strips and/or the third and fourth conductive strips are linear in shape.

12. The phase shifter as claimed in claim 1 wherein the first and second conductive strips have sufficient overlap with the third and fourth conductive strips over an entire range of operation so as to provide high capacitive coupling.

13. A variable differential phase shifter assembly comprising a pair of variable differential phase shifters as claimed in claim 1, wherein the Wilkinson dividers of said pair of variable differential phase shifters each include a wiper arm and are commonly fed.

14. The variable differential phase shifter assembly is as claimed in claim 13 wherein the pair of phase shifters are respectively linear shaped phase shifters.

15. The variable differential phase shifter assembly as claimed in claim 13 wherein the phase shifters are wiper type phase shifters and the third and fourth conductive strips of the respective pair of variable differential phase shifters are in the form of corresponding arcs of different radius about a common center of rotation of the wiper arms.

16. An adjustable beam antenna having a plurality of radiating elements fed by a feed network, wherein the feed network includes first and second phase shifters, where the first phase shifter is configured to vary down tilt, and the second phase shifter is a variable differential phase shifter as claimed in claim 1 located above a ground plane and configured to vary azimuth.

17. An isolated variable power divider comprising an isolated variable differential phase shifter and a hybrid coupler.

18. The isolated variable power divider as claimed in claim 17 wherein the isolated variable differential phase shifter includes a Wilkinson divider.

19. The isolated variable power divider as claimed in claim 17 and wherein the isolated variable differential phase shifter includes:

a Wilkinson divider having first and second conductive strips extending from outputs of the divider; and third and fourth conductive strips maintained in an electrically coupled overlapping relationship with respective first and second conductive strips;

wherein the Wilkinson divider and the first and second conductive strips of the Wilkinson divider are movable with respect to the third and fourth conductive strips so as to vary an effective path length from the Wilkinson divider to output ports of the third and fourth conductive strips.

20. The isolated variable power divider as claimed in claim 17 wherein outputs of the variable differential phase shifter are fed to inputs of the hybrid coupler, and an output of the hybrid coupler is fed to a power divider further which divides the output between two output parts.

21. A variable differential phase shifter comprising:

a power divider having first and second conductive strips extending from the outputs of the divider; and third and fourth conductive strips maintained in an electrically coupled overlapping relationship with respective first and second conductive strips, wherein the power divider and the first and second conductive strips are movable with respect to the third and fourth conductive strips so as to vary an effective path length from the power divider to output ports of the third and fourth conductive strips, and wherein the power divider includes an isolation element to provide isolation between the output ports.

22. A feed network for an antenna array comprising:

a first phase shifter for varying down tilt;

a second phase shifter for varying azimuth, wherein the second phase shifter is a variable differential phase shifter including:

a Wilkinson divider having first and second conductive strips extending from outputs of the divider; and third and fourth conductive strips maintained in an electrically coupled overlapping relationship with respective first and second conductive strips;

wherein the first and second conductive strips of the Wilkinson divider are movable with respect to the third and fourth conductive strips so as to vary an effective path length from the Wilkinson divider to output ports of the third and fourth conductive strips.

23. A wiper-type variable differential phase shifter having a wiper arm that includes a Wilkinson divider.

24. A wiper-type variable differential phase shifter having a wiper arm including an isolation element which isolates the outputs of the phase shifter from each other.

25. The phase shifter as claimed in claim 24 wherein the isolation element is a Wilkinson power divider.

26. The phase shifter as claimed in claim 24 wherein the isolation element is a hybrid coupler.

27. The phase shifter as claimed in claim 24 wherein the isolation element is an unbalanced power divider.

28. The phase shifter as claimed in claim 24 wherein the isolation element is a lossy power divider.

* * * * *